US006220492B1

(12) United States Patent
Huang

(10) Patent No.: US 6,220,492 B1
(45) Date of Patent: Apr. 24, 2001

(54) ANTI-SLIP PAD FOR STRAP, BELT OR THE LIKE

(76) Inventor: Daniel Huang, No. 87-15, Gi Fong Rd. Wi Fong Hsiang, Taichung Hsien (TW)

( * ) Notice: Subject to any disclaimer, the term of this patent is extended or adjusted under 35 U.S.C. 154(b) by 0 days.

(21) Appl. No.: 09/435,681

(22) Filed: Nov. 8, 1999

(30) Foreign Application Priority Data

Jul. 1, 1999 (TW) ..... 088200292

(51) Int. Cl.[7] ..... A41F 15/02

(52) U.S. Cl. ..... 224/264; 224/643; 2/268; D3/327

(58) Field of Search ..... 224/264, 267, 224/642, 643; 2/268; D3/327; D2/639

(56) References Cited

U.S. PATENT DOCUMENTS

D. 408,435 * 4/1999 Gettings ..... D17/20
D. 409,648 * 5/1999 Gettings ..... D17/20
D. 415,785 * 10/1999 Gettings ..... D17/20
1,546,067 * 7/1925 Goldschmidt ..... 224/264
1,631,694 * 6/1927 Rick ..... 224/264
3,799,413 * 3/1974 McBain ..... 224/264
5,250,345 * 10/1993 Chu ..... 428/156
5,507,422 * 4/1996 Shields ..... 224/264

* cited by examiner

*Primary Examiner*—Stephen K. Cronin
(74) *Attorney, Agent, or Firm*—Charles E. Baxley

(57) ABSTRACT

An anti-slip pad for a belt includes a number of members disposed together and parallel to each other and coupled together at live hinges, and/or having the end portions secured together at coupling bars. The pad includes two or more slots for threading the belt. The members disposed between every two adjacent members may each include a size smaller than that of the adjacent members for forming a space between the members and for receiving the belt. The members may include a hollow structure and may include a curved outer peripheral surface for engaging with a user.

8 Claims, 4 Drawing Sheets

ANTI-SLIP PAD FOR STRAP, BELT OR THE LIKE

BACKGROUND OF THE INVENTION

1. Field of the Invention

The present invention relates to a pad, and more particularly to an anti-slip pad for straps, belts or the like.

2. Description of the Prior Art

Typical suitcases, bags, luggage articles, schoolbags, or even trousers comprise a body and a shoulder belt or a sling strap secured thereto for carrying purposes, etc. The typical fastening seat belts for vehicles are directly engaged onto the users and may hurt the users. For preventing the users from being directly engaged with the belt or the strap, a protective pad is provided and engaged onto the belt or the strap for engaging with the users. One typical pad for attaching onto the belt or the strap is shown in FIG. 5 and comprises a longitudinal pad body 10 having two slits 11, 12 formed therein for threading the belt or the strap 20. Normally, the pad body 10 is entirely engaged with the user and is made of plastic material and includes a hardness that the user may not feel comfortable; i.e., the pad body 10 may not provide a suitable comfortableness to the users.

The present invention has arisen to mitigate and/or obviate the afore-described disadvantages of the conventional pads for straps or belts.

SUMMARY OF THE INVENTION

The primary objective of the present invention is to provide an anti-slip pad for engaging onto the straps, the belts or the like, and for providing a comfortable cushioning structure to the users.

In accordance with one aspect of the invention, there is provided an anti-slip pad for a belt comprising two or more groups of body members, each of the groups including two first body members and a second body member disposed between and coupled to the first body members, the second body member including two sides adjacent to the first body members and each having a slot formed therein for threading the belt, the second body member including a size smaller than that of the first body members for forming and defining a space between the second body member and the first body members and for receiving the belt.

The second body member and the first body members include two ends secured together at coupling bars; and are disposed parallel to each other and secured together at live hinges.

The first and the second body members each includes a chamber formed therein for forming a hollow structure. The body members of the first body members each includes a curved outer peripheral surface for engaging with a user.

The groups of body members include two adjacent first body members secured together at a live hinge, and each having a recess formed therein for receiving and for positioning the belt, or each having two shoulders formed therein for positioning the belt.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
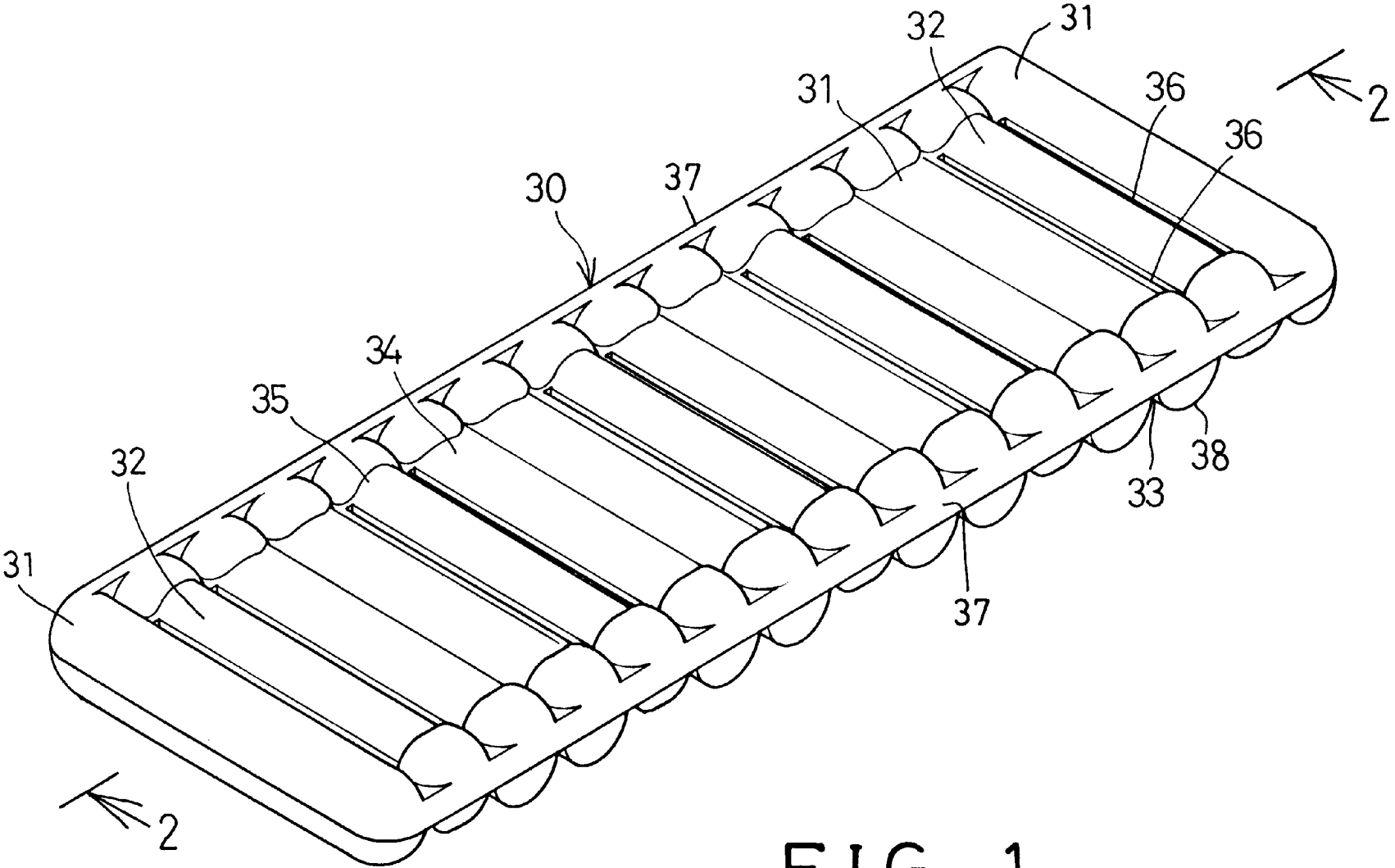
FIG. 1 is a perspective view of an anti-slip pad in accordance with the present invention.
Figure 2:
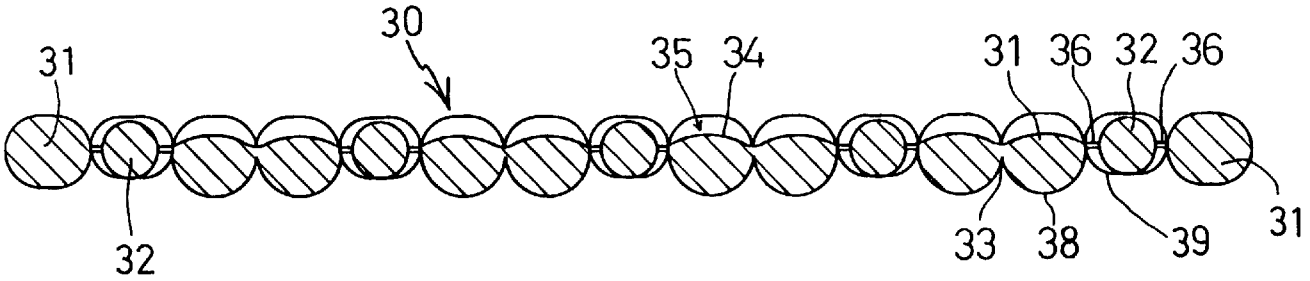
FIG. 2 is a cross sectional view taken along lines 2—2 of FIG. 1.

Referring to the drawings, and initially to FIGS. 1 and 2, an anti-slip pad in accordance with the present invention is generally indicated with the reference numeral "30" and comprises a number of body members 31, 32, such as the longitudinal body members 31, 32 as shown in the drawings, disposed parallel to each other and pivotally secured together at live hinges 33 and/or having the end portions secured together at coupling members 37, such as the coupling bars 37. The body members 31, 32 each includes a longitudinal rod shape having a curved or circular cross section. For example, as shown in FIG. 2, the bottom portions of the body members 31, 32 each includes a curved surface 38 for defining the live hinges 33 between the body members 31, 32 and for reducing the engaging areas with the users or the objects 41 (FIG. 4), and for allowing the pad 30 to be easily bent according to the shape of the object 41 onto which the pad 30 is engaged.

As best shown in FIG. 2, one of the body members 32 is disposed between every two adjacent body members 31 for forming a group of three body members. The anti-slip pad 30 may include one or more groups of the body members. For example, five groups of body members are shown in the drawings. The pad 30 may also include only two body members 31 and one body member 32 disposed between the body members 31. In addition, the body members 31, 32 are not necessarily formed as the longitudinal shape, but may be formed into various shapes or sizes. Alternatively, the body members 31, 32 may be arranged one by one and no two body members 32 are secured together or adjacent with each other. Or, the two adjacent body members 32 may be formed into one piece or taken as a single body member 32.

Figure 3:
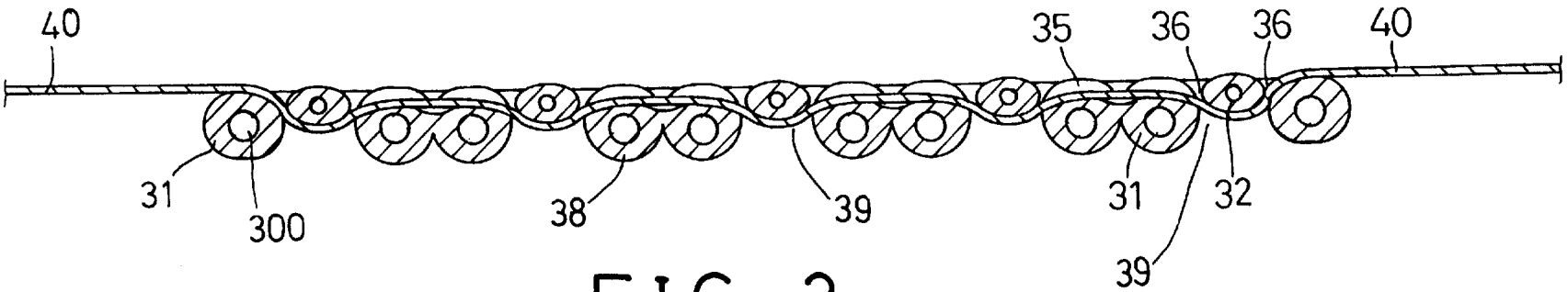
FIGS. 3 and 4 are cross sectional views similar to FIG. 2, illustrating the operation of the anti-slip pad.
Figure 4:
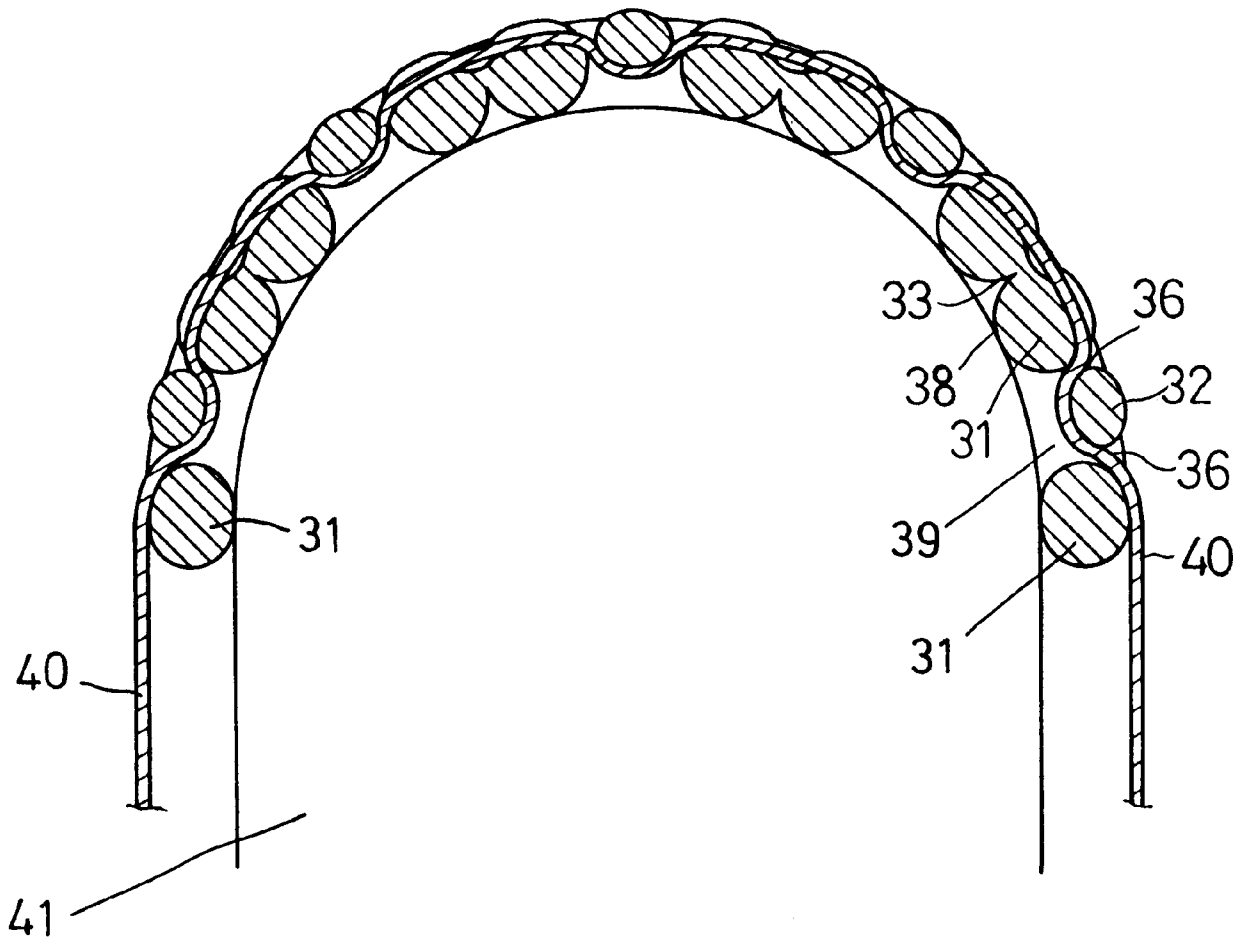
Figure 5:
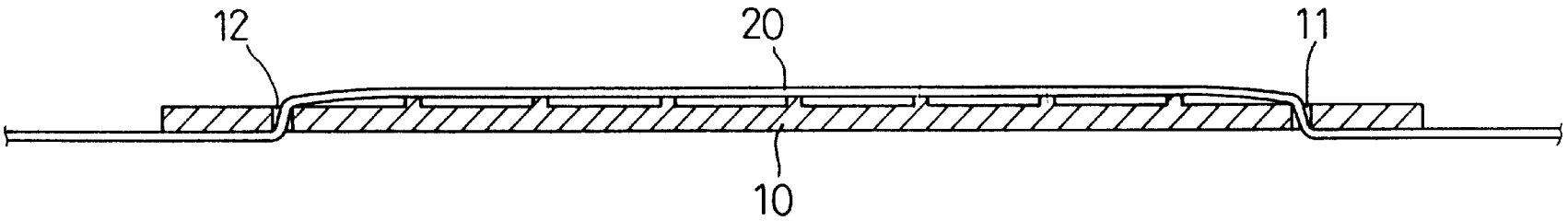
FIG. 5 PRIOR ART
FIG. 5 is a cross sectional view showing a typical pad for the belts or the straps.

Every two adjacent body members 31, 32 have the live hinge 33 provided and formed therebetween. The live hinges 33 on the sides of each of the body members 32 each includes a slot 36 formed therein for threading a strap or a belt 40 or the like. Alternatively, no live hinges are formed and provided between the body members 32 and the body members 31 adjacent thereto. Only the slots 36 are formed and provided between the body members 32 and the adjacent body members 31 which may also he coupled together at the ends thereof with the coupling bars 37. The body member 32 of each of the groups of body members includes a depth or thickness less than that of the adjacent body members 31 such that a space 39 is formed and defined between the body members 31, 32 for receiving the belt 40 and for preventing the belt 40 from engaging with the users (FIGS. 3, 4). It is preferable that the body members 31 each includes a recess 34 formed in the upper portion thereof and defined between two shoulders 35 for receiving the belt 40 and for stably retaining the belt 40 in place relative to the body members 31.

The anti-slip pad 30 or the body members 31, 32 are preferably made of spongy materials, foamable materials, rubber materials, gel materials, or the other synthetic materials, such as ethylene vinyl acetate copolymer, etc. The body members 31, 32 may each further include a chamber 300 formed therein (FIG. 3) for forming a hollow structure and for further increasing the resilience of the pad 30.

Accordingly, the anti-slip pad in accordance with the present invention may be engaged onto the straps, the belts or the like for providing a comfortable cushioning structure to the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An anti-slip pad for a belt, said pad comprising:

at least two groups of body members, each of said at least two groups of body members including two first body members and a second body member disposed between and coupled to said first body members, said second body member including two sides adjacent to said first body members and each having a slot formed therein for threading the belt, said second body member including a size smaller than that of said first body members for forming and defining a space between said second body member and said first body members and for receiving the belt, wherein said at least two groups of body members include two adjacent first body members secured together at a live hinge.

2. The anti-slip pad according to claim 1, wherein said second body member and said first body members include two ends secured together at coupling bars.

3. The anti-slip pad according to claim 1, wherein said second body member and said first body members are disposed parallel to each other and secured together at live hinges.

4. The anti-slip pad according to claim 1, wherein said second body member includes a chamber formed therein for forming a hollow structure.

5. The anti-slip pad according to claim 1, wherein said body members of said first body members each includes a curved outer peripheral surface for engaging with a user.

6. The anti-slip pad according to claim 1, wherein said body members of said first body members each includes a chamber formed therein for forming a hollow structure.

7. The anti-slip pad according to claim 1, wherein said adjacent first body members of said at least two groups of body members that are secured together at said live hinge each includes a recess formed therein for receiving and for positioning the belt.

8. The anti-slip pad according to claim 1, wherein said adjacent first body members of said at least two groups of body members that are secured together at said live hinge each includes two shoulders formed therein for positioning the belt.

* * * * *